US005243389A

United States Patent [19]

Yamane et al.

[11] Patent Number: 5,243,389

[45] Date of Patent: Sep. 7, 1993

[54] TONER HOPPER HAVING STIRRING AND FEEDING ROLLERS

[75] Inventors: Naoyuki Yamane, Koriyama; Keiji Kato, Nara; Katsuzo Uchida, Ikoma; Miki Demoto, Koriyama; Hisashi Kunihiro, Tenri; Hiroshi Kawahito; Yasuo Imai, both of Kitakatsuragi; Masato Asanuma, Ikoma; Yukinori Andou, Nara; Takashi Sugito, Tenri, all of Japan

[73] Assignee: Sharp Kabushiki Kaisha, Osaka, Japan

[21] Appl. No.: 898,967

[22] Filed: Jun. 12, 1992

[30] Foreign Application Priority Data

Jun. 13, 1991 [JP] Japan ..... 3-142024
Jan. 14, 1992 [JP] Japan ..... 4-5033

[51] Int. Cl.[5] ..... G03G 15/08

[52] U.S. Cl. ..... 355/245; 355/260; 222/DIG. 1

[58] Field of Search ..... 355/245, 260; 222/238, 222/DIG. 1

[56] References Cited

U.S. PATENT DOCUMENTS 3,946,910 3/1976 Case ..... 222/DIG. 1 X

FOREIGN PATENT DOCUMENTS 61-99176 5/1986 Japan .

*Primary Examiner*—Joan H. Pendegrass
*Attorney, Agent, or Firm*—David G. Conlin; George W. Neuner

[57] ABSTRACT

A toner hopper is arranged to feed the toner stored in itself to a developing unit and have a stirring roller and a feeding roller respectively supported rotatably, an interlocking mechanism for transmitting the force of rotation to the stirring roller, a manually rotating mechanism for manually rotating the stirring roller, and an interlocking restricting mechanism. The interlocking mechanism restricts the operation of the interlocking mechanism such that the force of rotation of the stirring roller is not transmitted to the feeding roller while the manually rotating mechanism supplies force of rotation to the stirring roller.

10 Claims, 13 Drawing Sheets

TONER HOPPER HAVING STIRRING AND FEEDING ROLLERS

BACKGROUND OF THE INVENTION

1. Field of the Invention

The present invention relates to a toner hopper which is capable of supplying toner to a developing unit through the effect of the rotation of a stirring roller and a feeding roller and is used in an image forming apparatus such as a copying machine for forming an image by means of an electrophotographic technique.

2. Description of the Related Art

The inventors of the present application know an image forming apparatus in which a toner hopper is attachable to a developing unit providing a magnet roller and a stirring roller for a developing agent. The toner hopper serves to feed a necessary amount of toner to a photosensitive drum of the developing unit. In the known image forming apparatus, after all the toner stored in the toner hopper is consumed by feeding it to the developing unit, it is necessary to attach a new toner hopper. Hence, to extend the operating period of the toner hopper, recently, the toner hopper having a larger toner capacity has been under study.

In such a large-capacity toner hopper, the toner is stored in the toner hopper for a relatively long time. Hence, a stirring roller is provided in the toner hopper for making the toner uniform and feeding of the toner to the developing unit easier.

The stirring roller is driven by a motor and transmits its force of rotation to a feeding roller through the effect of an interlocking mechanism composed of gear trains. The stirring roller is rotated as being interlocked with the feeding roller.

In the known toner hopper described above, the stirring roller is constantly interlocked with the feeding roller through the effect of the gear mechanism. Hence, the distance between toner particles stored in the toner hopper are stuck together so that the particle density of the toner is made larger, resulting in fixing toner particles. This is due to the vibration taking place when the toner hopper is in transportation and the adverse effect of the long-term storage of the toner in the toner hopper. Immediately after attaching the toner hopper to the developing unit, the fixed toner particles need the driving means (motor) to supply more force of rotation to the feeding roller and the stirring roller. This results in disabling to rotate the stirring roller and the feeding roller and often causing the driving means to be in trouble.

To overcome the shortcomings, it is necessary to provide a driving means for producing larger force of rotation. However, it brings about the other disadvantages, that is, the enlargement and the cost-up of the device itself.

SUMMARY OF THE INVENTION

It is therefore an object of the present invention to provide a toner hopper which is capable of preventing the occurrence of operating trouble and failure, reducing the device itself in size and lowering the cost of the device.

In carrying out the object, according to a first aspect of the invention, a toner hopper arranged to feed toner stored in it into a developing unit includes: a stirring roller fitted on a shaft; a feeding roller fitted on another shaft; an interlocking mechanism for transmitting force of rotation of the stirring roller to the feeding roller; means for manually rotating the stirring roller; means for restricting the interlocking mechanism so that the force of rotation of the stirring roller is disallowed to be transmitted to the feeding roller while the manually rotating means supplies force of rotation to the stirring roller.

According to a second aspect of the invention, a toner hopper arranged to feed toner stored in it into a developing unit includes: a stirring roller fitted on a shaft; a feeding roller fitted on another shaft; an interlocking mechanism for transmitting force of rotation of the stirring roller to the feeding roller to the feeding roller; and means for inhibiting the transmission of the force of rotation of the stirring roller to the feeding roller by means of the interlocking mechanism between the attachment of the toner hopper to the developing unit and the initial toner feeding.

According to a third aspect of the invention, a toner hopper constructed according to the first aspect of the invention further includes the manually rotating means which provides means for inhibiting the rotation of the stirring roller in an opposite direction to the direction in which the force of rotation is supplied to the stirring roller.

According to a fourth aspect of the invention, a toner hopper arranged to feed toner stored in it into a developing unit includes: a stirring roller fitted on a shaft; a feeding roller fitted on another shaft; an interlocking mechanism for transmitting force of rotation of the stirring roller to the feeding roller to the feeding roller; and means for supplying force of rotation to the stirring roller when the toner hopper is attached to the developing unit.

According to a fifth aspect of the invention, a toner hopper arranged to feed toner stored in it into a developing unit includes: a stirring roller fitted on a shaft; a feeding roller fitted on another shaft; an interlocking mechanism for transmitting force of rotation of the stirring roller to the feeding roller to the feeding roller; means for switching a supply voltage fed to the driving means when the driving means starts to be driven into a higher supply voltage than that at the normal operation of the stirring roller; and means for restricting the interlocking mechanism, for inhibiting the transmission of the force of rotation of the stirring roller to the feeding roller when the driving means starts to be driven.

In the operation of the first invention, with the manually rotating means, the force of rotation is manually supplied to the stirring roller. While the manually rotating means is feeding the force of rotation to the stirring roller, the interlocking restricting means serves to restrict the interlocking mechanism for transmitting the force of rotation of the stirring roller fed by the driving means to the feeding roller so as to stop transmitting the rotation of the stirring roller to the feeding roller. As such, before attaching the toner hopper to the developing unit, an operator uses the manually rotating means for manually rotating only the stirring roller so as to separate the fixed toner particles stored in the toner hopper. Then, the toner hopper is attached to the developing unit. No excessive load is applied to the driving means if the stirring roller and the feeding roller are driven in combination. It is therefore possible to prevent the occurrence of the operating trouble and the failure and reduce the size of and lower the cost of the device.

In the operation of the second invention, between when the toner hopper is attached to the developing unit and when the first toner is fed, the interlocking inhibiting means serves to inhibit the transmission of the rotation of the stirring roller to the feeding roller. During that interval, no force of rotation is transmitted from the driving means to the feeding roller, so that only the stirring roller is allowed to stir the toner. As such, no excessive load is applied to the driving means. It is hence possible to prevent the occurrence of the operating trouble and the failure, reduce the size of and lower the cost of the device.

In the operation of the third invention, the reversing inhibiting means serves to inhibit the rotation of the stirring roller in an opposite direction to the transmitting direction of the rotation to the stirring roller in the first invention. As such, no excessive load is applied to the stirring roller. This makes it possible to prevent the occurrence of the operating trouble and the failure, reduce the size of and lower the cost of the device.

In the operation of the fourth invention, when the toner hopper is attached to the developing unit, the rotation supplying means serves to supply the force of rotation to the stirring roller so that the toner stored in it may be stirred. As such, when the toner hopper is attached to the developing unit, the stirring roller is automatically rotated so that the fixed toner particles in the toner hopper are allowed to be separated. If, hence, the stirring roller and the feeding roller are driven in combination, no excessive load is applied to the driving means. This results in being able to prevent the occurrence of the operating trouble and the failure, reduce the size of and lower the cost of the device.

In the operation of the fifth invention, when starting the driving means, the control means serves to switch the supply voltage to a higher voltage than that in a normal operation. Further, the interlocking restricting means serves to restrict the force of rotation conveyed from the stirring roller to the feeding roller. As such, the fixed toner particles stored in the toner hopper are allowed to be separated. If the stirring roller and the feeding roller are driven in combination, no excessive load is applied to the driving means. This results in being able to prevent the occurrence of the operating trouble and the failure, reduce the size of and lower the cost of the device.

Further objects and advantages of the present invention will be apparent from the following description of the preferred embodiments of the invention as illustrated in the accompanying drawings.

DESCRIPTION OF THE PREFERRED EMBODIMENTS

Figure 1:
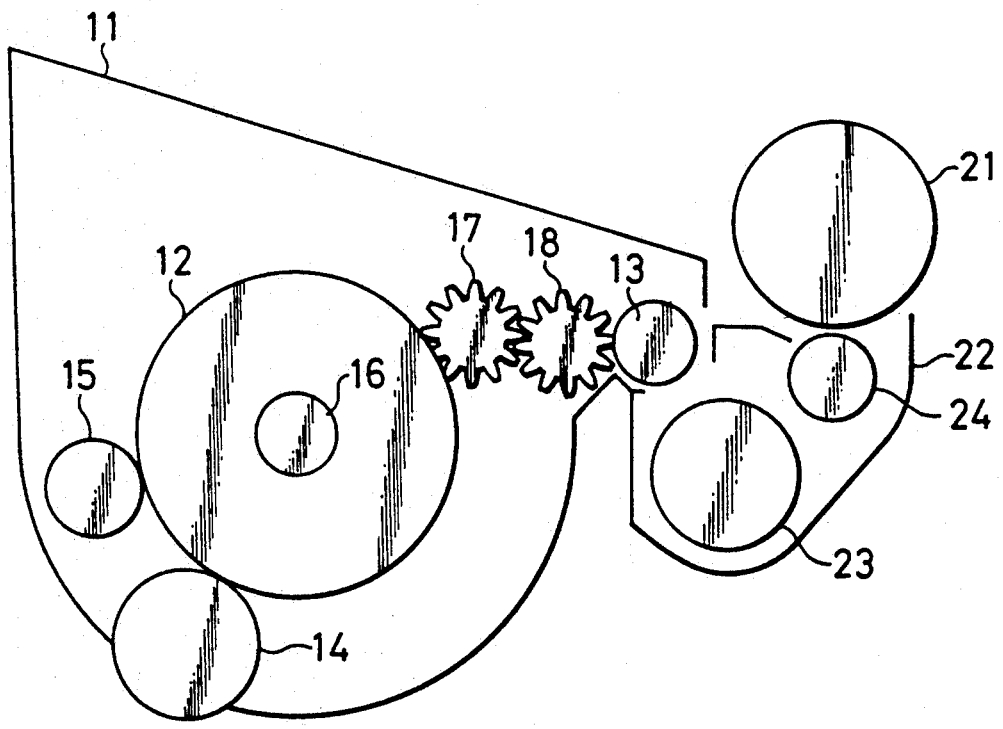
FIG. 1 is a front view schematically showing a toner hopper according to an embodiment of a first invention.

Herein, the description will be directed to embodiments of the present invention as referring to the drawings.

Figure 2:
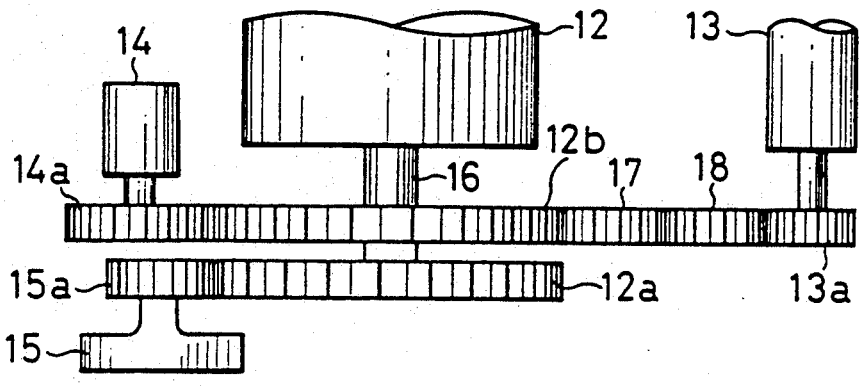
FIG. 2 is a front view schematically showing an essential portion of the toner hopper shown in FIG. 1.

FIG. 1 is a front view schematically showing a toner hopper according to a first embodiment of a first invention. FIG. 2 is a front view schematically showing an essential portion of the toner hopper shown in FIG. 1.

Figure 21:
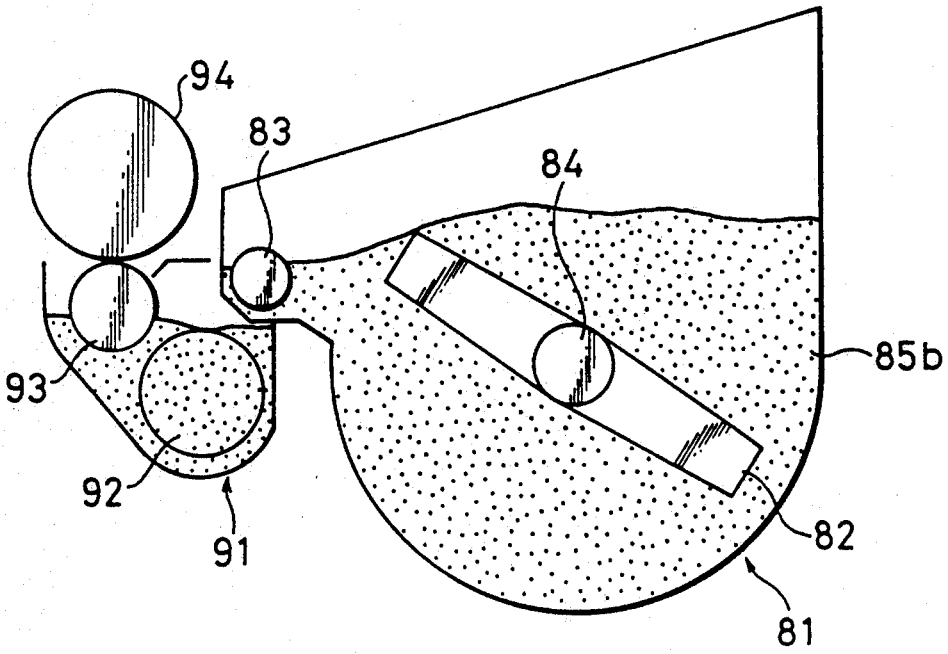
FIG. 21 is a schematic view showing the state of the toner appearing after the stirring roller included in a toner hopper according to the fifth invention terminates one turn.

As shown in FIGS. 1 and 2, 21 is a photosensitive drum provided in an image forming apparatus used in a copying machine. 22 is a developing unit for feeding toner to the photosensitive drum 21. 11 is a toner hopper, which is freely attachable to the developing unit 22.

The developing unit 22 provides a developing-agent stirring roller 23 and a magnet roller 24. The toner fed to the developing unit 22 is stirred by the stirring roller 23. The stirred toner is fed to the photosensitive drum 21 with the stirred toner being attracted on the magnet roller 24.

Inside of the toner hopper 11, a stirring roller 12 and a feeding roller 13 are fitted on the shafts. The toner hopper 11 provides a manual gear 12*a*, gears 12*b*, 13*a*, a motor 14, a motor gear 14*a*, a handle 15, a handle gear 15*a*, a rotation shaft 16, and gears 17, 18. The rotation of the motor 14 is transmitted to the stirring roller 12 through the motor gear 14*a* and the gear 12*b* being engaged with each other. The rotation of the gear 12*b* is transmitted to the feeding roller 13 through the gear train 17 and 18 and the gear 13*a*. The gear train 17 and 18 compose an interlocking mechanism. The rotation of the motor 14 is transmitted to the stirring roller 12 and the feeding roller 13.

The rotation shaft 16 for supporting the stirring roller 12 is fixed at the central position of the stirring roller 12. The rotation shaft 16 provides the manual gear 12*a* fixed on one end thereof. On the other hand, the gear 12*b* is provided rotatably to the rotation shaft 16. The gear 12*b* is engaged with the motor gear 14*a* and the gear 17. That is, the gear 12*b* is allowed to be rotated independently of the rotation shaft 16. The manual gear 12*a* fixed on one end of the rotation shaft 16 is engaged with the handle gear 15*a*. The handle gear 15*a* provides a handle 15 to be freely attached.

FIG. 3 is a rear view schematically showing an essential portion of the toner hopper shown in FIG. 1.

As shown, the manual gear 12*a* has a cut-away on its peripheral portion. The cut-away portion is not engaged with the handle gear 15*a*. The manual gear 12*a* and the gear 12*b* provide projections 26 and 27 on their opposite sides, respectively. These projections 26 and 27 are allowed to be pressed against each other.

Figure 3A:
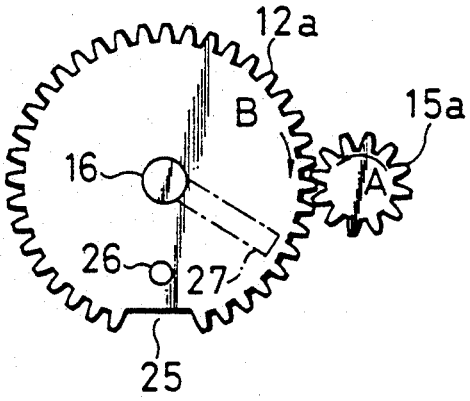
FIG. 3(A) is a rear view schematically showing a rotating state of the essential portion of the toner hopper shown in FIG. 1 when the stirring roller is rotated by handle 15.

Before the toner hopper 11 is attached to the developing unit 22, as shown in FIG. 3A, the handle gear 15 is engaged with the manual gear 12*a*. In this state, the handle gear 15*a* is rotated toward an arrow A by operating the handle 15. The handle gear 15 is allowed to rotate toward an arrow B together with the rotation shaft 16. At a time, the stirring roller 12 fixed on the rotation shaft 16 is rotated inside of the toner hopper 11 so as to stir the toner stored inside of the toner hopper 11. The gear 12*b* which is not fixed on the rotation shaft 16 is disallowed to rotate. Hence, by operating the handle 15, the rotation of the stirring roller 12 is transmitted to the feeding roller 13.

When the stirring roller 12 is kept rotating for a while by operating the handle 15, the cut-away 25 of the manual handle 12*a* reaches a place where it is opposed to the handle gear 15*a*. Hence, the manual gear 12*a* is not engaged with the handle gear 15*a*. In this state, the stirring roller 12 is not rotated even by rotating the handle 15. That is, by operating the handle 15, only the stirring roller 12 is allowed to rotate from the state shown in FIG. 3A to the state shown in FIG. 3B. This corresponds to substantially one rotation.

Figure 3B:
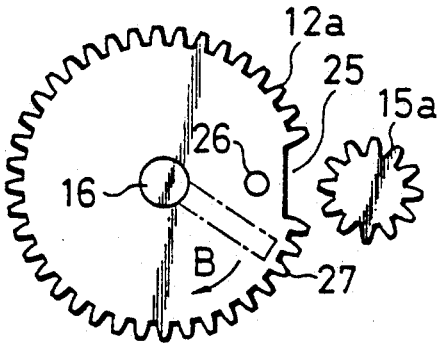
FIG. 3(B) is a rear view schematically showing a rotating state of the essential portion of the toner hopper shown in FIG. 1 when the stirring roller is not rotated by handle 15.

Then, when the motor 14 is driven, the rotation of the motor is transmitted from the motor gear 14*a* to the gear 12*b*. At this time, the projection formed on the gear 12*b* is rotated toward an arrow B as shown in FIGS. 3A and 3B.

Since the gear 12*b* is not fixed on the rotation shaft 16, at this time, the rotation shaft 16 and the stirring roller 12 are not allowed to rotate. When the rotation of the gear 12*b* causes the projection 27 to come into contact with the projection 26 of the manual gear 12*a*. Then, the manual gear 12*a* is allowed to rotate as being interlocked with the gear 12*b*.

At a time, the rotation shaft 16 is also rotated with the manual gear 12*a* being fixed on one end of the shaft 16. As such, the stirring roller 12 fixed on the rotation shaft 16 is rotated inside of the toner hopper 11. The rotation of the gear 12*b* is transmitted to the gear 13*a* through the gear trains 17 and 18, thereby causing the feeding roller 13 to rotate.

According to this embodiment, before mounting the toner hopper 11 to the developing unit 22, only the stirring roller 12 is allowed to rotate by operating the handle 15 so that the toner stored in the toner hopper 11 may be stirred, thereby causing the fixed toner particles to be separated. At a time, the rotation of the handle gear 15*a* is not transmitted to the gear trains 17 and 18 and the feeding roller 13. Hence, no load from the feeding roller 13 is applied to the handle gear 15*a*, resulting in allowing the stirring roller 13 to rotate with a relatively small power.

After overcoming the toner fixing state, the toner hopper 11 is attached to the developing unit 2. Then, the rotation of the motor is transmitted to the stirring roller 12 and the feeding roller 13 so that those rollers 12 and 13 are allowed to rotate. Since the stirring roller 12 stirs the stuck toner for separating the toner particles, no large load is applied to the motor 14.

According to the first embodiment of the first invention, as described above, before attaching the toner hopper 11 to developing unit 22, only the stirring roller 12 is allowed to rotate manually so that the fixed toner particles stored in the toner hopper 11 may be separated. When the toner hopper 11 is attached to the developing unit 22, no excessive load is applied to the motor 14. Hence, the motor 14 enables to rotate the stirring roller 12 and the feeding roller 13 without further power.

The construction of the first invention, therefore, makes it possible to prevent the occurrence of the operating trouble and the failure, reduce the size of and lower the cost of the device.

Figure 4:
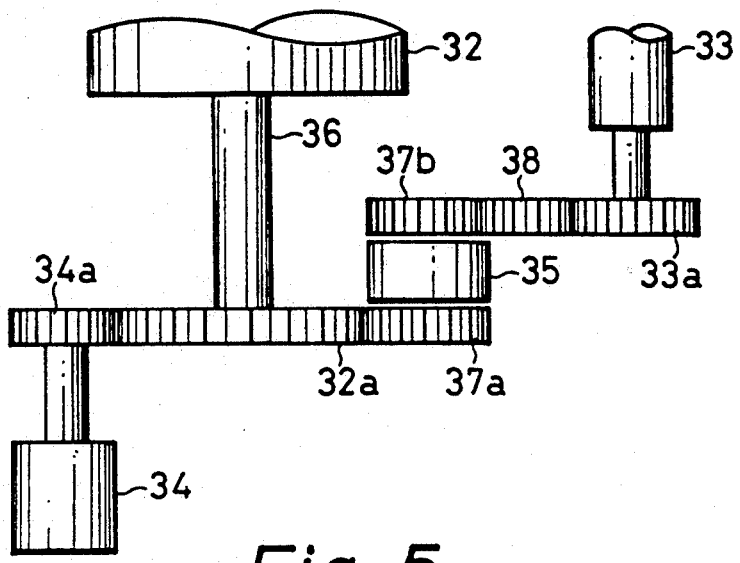
FIG. 4 is a plan view showing an essential portion of a toner hopper according to a first embodiment of a second invention.

FIG. 4 is a plan view schematically showing the construction of an essential portion of the toner hopper according to a first embodiment of a second invention.

Inside of the toner hopper, as shown in FIG. 4, a stirring roller 32 and a feeding roller 33 are fitted on their shafts. The toner hopper provides gears 32*a*, 33*a*, a motor 34, a motor gear 34*a*, a clutch 35, a rotation shaft 36, a gear 37*a*, a gear 37*b*, and an idle gear 38.

The rotation of the motor 34 is transmitted to the rotation shaft 36 with the motor gear 34*a* being engaged with the gear 32*a*, so that the stirring roller 32 fixed on the rotation shaft 36 is allowed to rotate.

On the other hand, the rotation of the gear 32*a* is transmitted to the gear 37*a*, the rotation of which is selectively transmitted to the gear 37*b* through the clutch 35. The rotation of the gear 37*b* is transmitted to the gear 33*a* through the idle gear 38 so that the feeding roller 33 fixed on the same axis as the gear 33*a* is allowed to rotate.

In the above construction, by switching on and off the clutch 35, the rotation of the gear 37 is connected to or disconnected from the gear 37*b*. Hence, immediately after the toner hopper is attached to the developing unit (not shown), if the clutch 35 is switched off, the rotation of the motor 34 is disallowed to be transmitted to the gear 37*b* or later-located components when the clutch 35 is off. Hence, only the stirring roller 32 is rotated.

Then, when the clutch 35 is switched on at a predetermined timing, the rotation of the motor 34 is transmitted to the feeding roller 33, resulting in being able to rotate the feeding roller 33 and the stirring roller 32 in combination.

Figure 5:
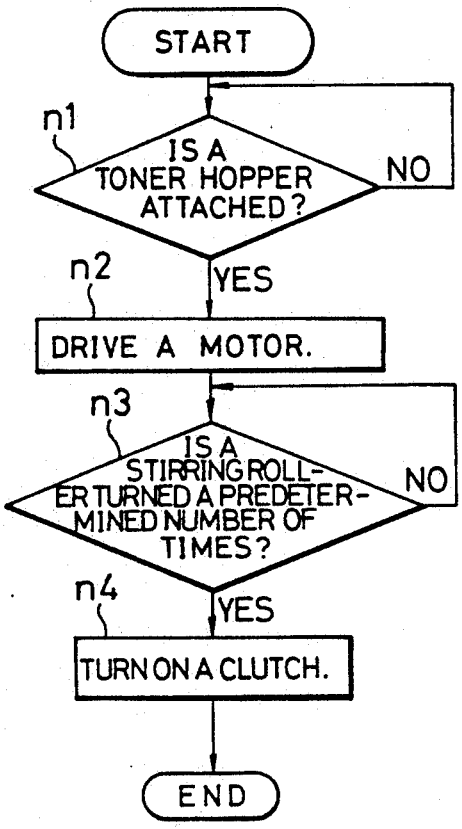
FIG. 5 is a flowchart showing a process for controlling a motor included in the toner hopper shown in FIG. 4.

FIG. 5 is a flowchart showing a procedure for controlling the motor 34 included in the toner hopper shown in FIG. 4.

On a timing when the clutch 35 is switched on, as shown, after the toner hopper is attached (step n1), the motor 34 is driven (step n2). When the motor 34 serves to rotate the stirring roller 32 a predetermined number of times (step n3), the clutch 35 is turned on (step n4).

With this process, the stuck toner stored in the toner hopper is completely broken into toner particles so as to lessen the load of the stirring roller 32 applied to the motor 34. Then, the feeding roller 33 is started.

According to the first embodiment of the second invention, during the time between when the toner hopper is attached to the developing unit and when the feeding of the toner is started, the rotation of the motor 34 is supplied to the stirring roller 32 only. Hence, without feeding unnecessary toner, the stuck toner is broken into particles. Then, the rotation of the motor 34 is transmitted to the feeding roller 33. Hence, no excessive load is applied to the motor 34.

It is, therefore, possible to prevent the occurrence of the operating trouble and the failure, reduce the size of and lower the cost of the device.

Figure 6:
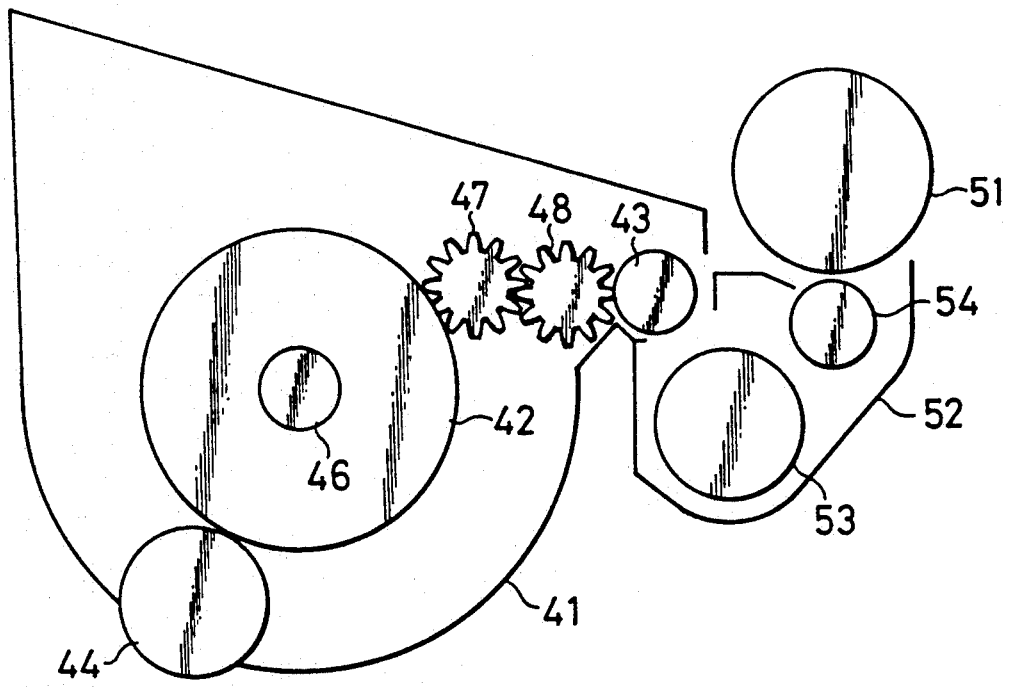
FIG. 6 is a front view schematically showing a toner hopper according to a second embodiment of the second invention.
Figure 7:
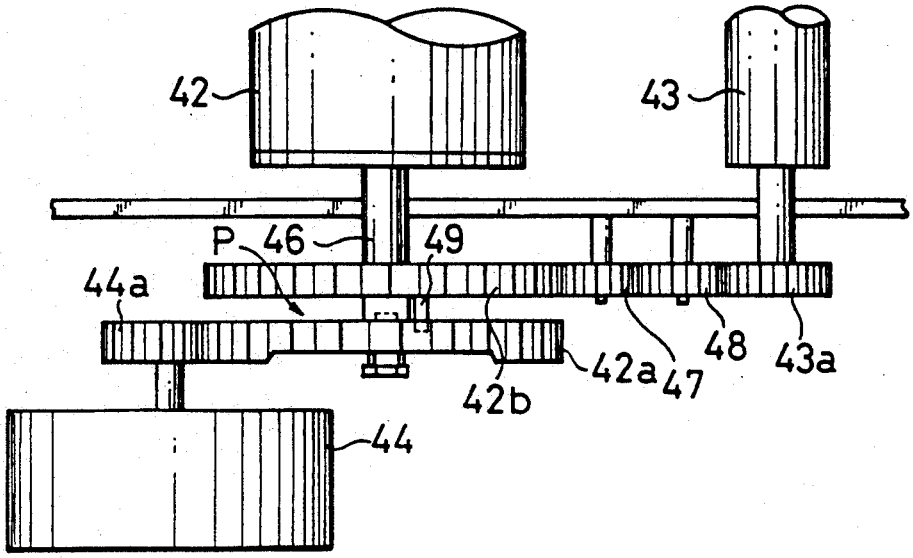
FIG. 7 is a front view schematically showing an essential portion of the toner hopper shown in FIG. 6.

FIG. 6 is a front view schematically showing a toner hopper according to a second embodiment of the second invention. FIG. 7 is a plan view schematically showing an essential portion of the toner hopper shown in FIG. 6.

As shown, the toner hopper 41 is allowed to be freely attached to the developing unit 52 for feeding the toner to the photosensitive drum 51 in the image forming apparatus.

The developing unit 52 provides a stirring roller 53 for a developing agent and a magnet roller 54. The toner fed into the developing roller 52 is stirred by the stirring roller 53 and is fed to the photosensitive drum 51 with the toner being attracted on the surface of the magnet roller 54.

Inside of the toner hopper 41, the stirring roller 42 and the feeding roller 43 are fitted on the shafts. The toner hopper 41 further provides gears 42*a*, 42*b*, 43*a*, a motor 44, a motor gear 44*a*, a rotation shaft 46, and gears 47 and 48.

The rotation shaft 46 supporting the stirring roller 42 is fixed at the central position of the stirring roller 42. The gear 42*b* provides a boss 49.

Figure 8:
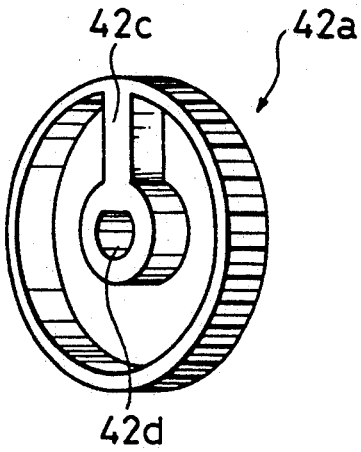
FIG. 8 is a perspective view showing a form of a gear.

FIG. 8 is a perspective view showing the gear 42*a*, which is viewed from an arrow P shown in FIG. 7.

As shown in FIG. 8, the gear 41*a* provides a rib 42*c* and a D cut 42*d* on the center of the gear. The D cut means a D-shaped hole. The end of the rotation shaft 46 is formed like a character D so that the end may be fitted to the D cut 42*d* of the gear 42*a*.

The rotation of the motor 44 is transmitted to the stirring roller 42 by engaging the motor gear 44*a* with the gear 42*a* and fitting the D cut 42*d* of the gear 42*a* to the end of the rotation shaft 46. On the other hand, the gear 42*b* engaged with the gear 47 is provided rotatably to the rotation shaft 46. That is, the gear 42*b* is allowed to rotate independently of the rotation shaft 46. The rotation of the gear 42*b* reaches the gear 43*a* through the gear trains 47 and 48 composing an interlocking mechanism. Through the gear 43*a*, the rotation is transmitted to the feeding roller 43.

Figure 9A:
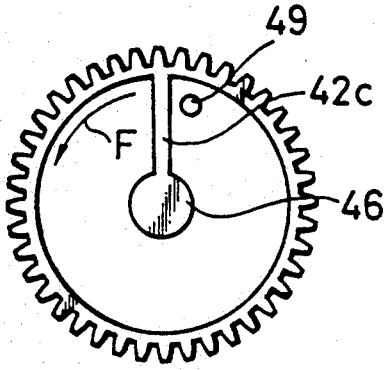
FIGS. 9*a* and 9*b* are a schematic view showing a positional relation between a rib and a boss when the gear is rotated.
Figure 9B:
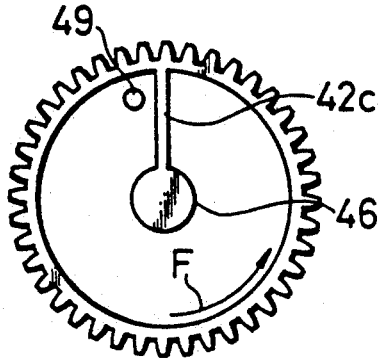

FIGS. 9*a* and 9*b* are a view schematically showing a positional relation between the rib 42*c* and the boss 49 when the gears are rotated. FIG. 9*a* shows a positional relation appearing when the toner hopper is attached to the developing unit. FIG. 9*b* shows a positional relation appearing when the toner hopper is attached to the developing unit and the gear 42*a* providing the rib 42*c* is rotated once.

At first, when the toner hopper is attached to the developing unit, the motor gear 44*a* is engaged with the gear 42*a*. As shown in FIG. 9*a*, both the rib 42*c* of the gear 42*a* and the boss 49 of the gear 42*b* keeps the positional relation in a manner to avoid the contact of the rib 42*c* with the boss 49 when the motor 44 starts to be driven and the rib 42*c* of the gear 42*a* is rotated toward an arrow F shown in FIG. 9*a*.

Next, the motor 44 is driven so that the rib 42*c* may be rotated toward an arrow F. The stirring roller 42 is rotated through the rotation shaft 46 so as to stir the toner in the toner hopper. At this time, the boss 49 is not rotated. Thus, the gear 42*b* is not rotated, resulting in disabling to rotate the feeding roller 43.

In turn, the gear 42*a* is turned substantially once, so that the rib 42*c* of the gear 42 may be fitted to the boss 49 as shown in FIG. 9*b*. When the gear 42*a* is further rotated toward an arrow F shown in FIGS. 9*a* and 9*b*, the gear 42*b* is rotated in concert with the gear 42*a* so that the feeding roller 43 is allowed to rotate. With the rotation of the feeding roller 43, the operation of feeding the toner to the developing unit is started.

With the above-mentioned operation, the rotation of the motor 44 is transmitted to the stirring roller 42 and the feeding roller 43.

Figure 10:
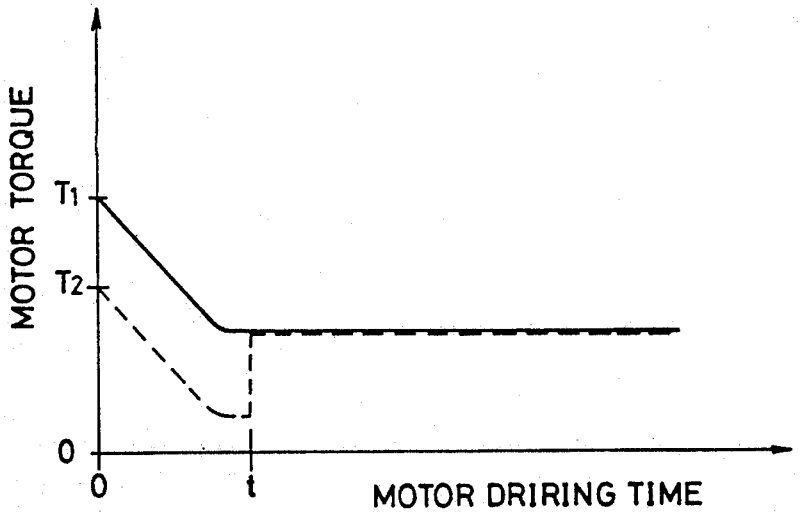
FIG. 10 is a graph showing a relation between a motor-driving time and the torque of the motor.

FIG. 10 is a graph showing a relation between a motor-driving time and a torque of the motor 44.

As shown in FIG. 10, the relation of the known toner hopper is indicated by a real line and the relation of the toner hopper of this embodiment is indicated by a broken line. t means a time from when the motor 44 starts to be driven and when the substantial turn of the stirring roller 42 is carried out.

As shown, after the time t, the toner hopper of this embodiment and the known toner hipper indicate the same results. Between the time 0 and the time t, however, the toner hopper of this embodiment needs T2 or more torque, which may be reduced in comparison with the torque T1 the known toner hopper needs.

According to this embodiment, the feeding roller 43 is not rotated at the initial stage of feeding the toner, concretely, until the rotation of the gear 42*a* gives a substantially one rotation of the stirring roller 42. That is, before the rotation of the feeding roller 43 starts the operation of feeding the toner, the rotation of the stirring roller 42 serves to stir the toner stored in the toner hopper 41. Then, the feeding roller 43 is operated as being interlocked with the stirring roller 42. Hence, no excessive load is applied to the motor, resulting in being able to reduce the torque the toner hopper needs.

It is therefore possible to prevent the occurrence of the operating trouble and the failure, reduce the size of and lower the cost of the device.

Figure 11:
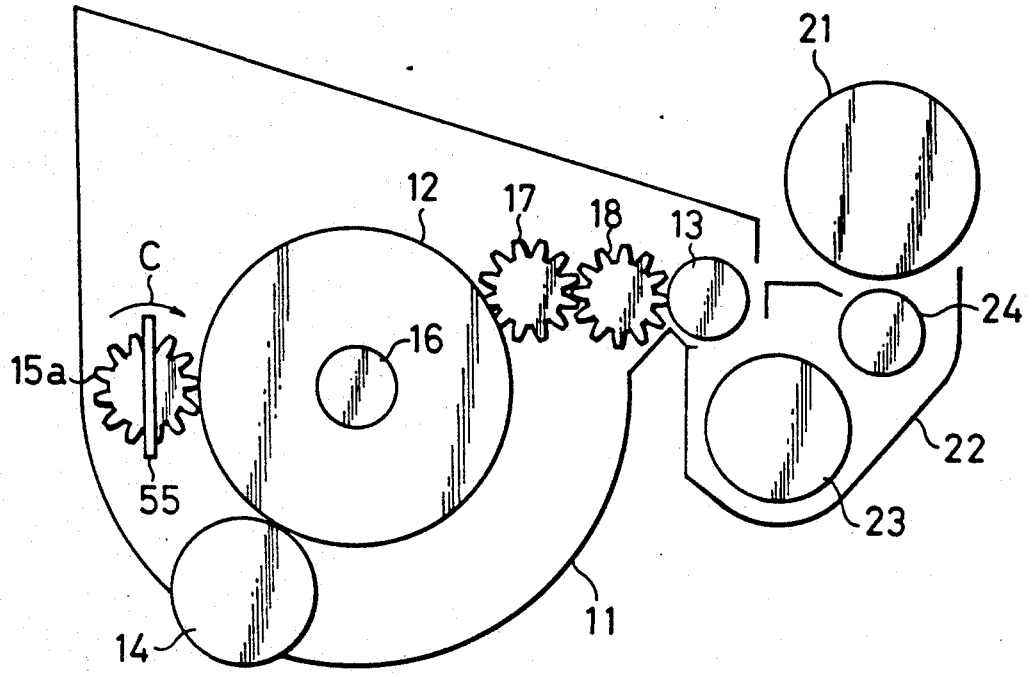
FIG. 11 is a front view schematically showing a transformation of the toner hopper according to the first invention.

FIG. 11 is a front view schematically showing a transformation of the toner hopper according to the first embodiment of the first invention.

The construction of the toner hopper shown in FIG. 11 is the same as that shown in FIG. 1 except the handle 55. The same components as those of FIG. 1 have the same reference numbers.

As shown, the handle 55 is a transformation of the handle 15 shown in FIG. 1. In FIG. 1, the handle 15 is formed to be circular as viewed from the front side, while in FIG. 11, the handle 55 is formed to be bar-like as viewed from the same position. The handle 55 is allowed to be turned right and left. Hence, in a case that the handle 55 is turned in another direction except the right direction (toward an arrow C), the large load can be applied to the rotation shaft 16 to be rotated through the handle gear 15*a* and the manual gear 12*a*. This may result in causing the components such as the rotation shaft 16 to be damaged.

In turn, the description will be directed to a toner hopper constructed to overcome the shortcoming.

Figure 12:
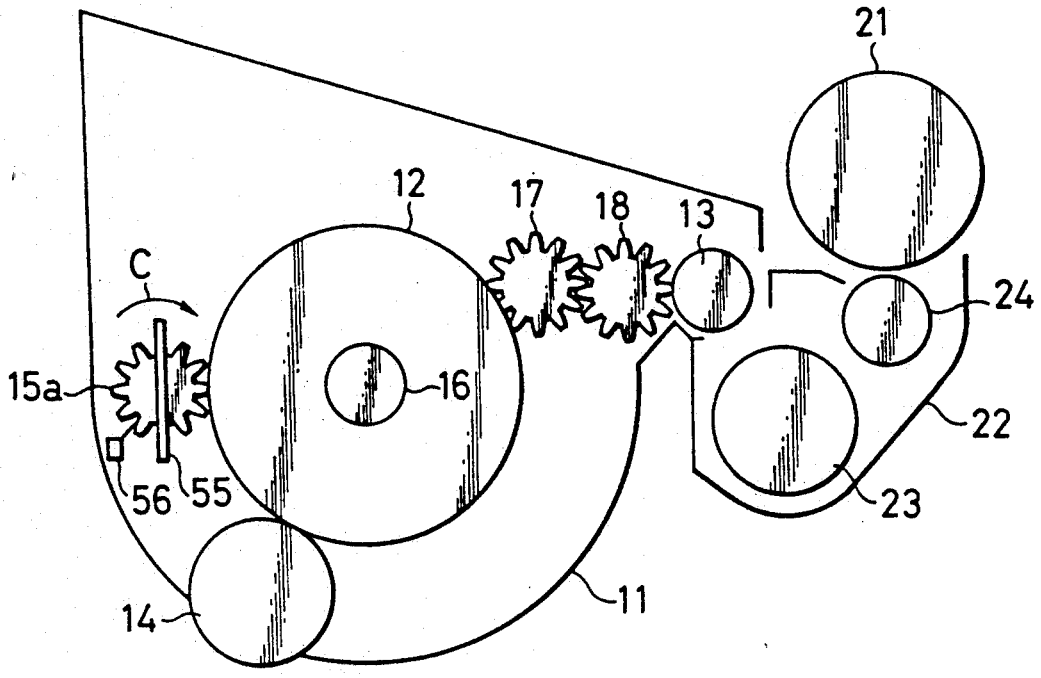
FIG. 12 is a front view schematically showing a toner hopper according to an embodiment of a third invention.

FIG. 12 is a front view schematically showing a toner hopper according to an embodiment of the third invention.

As shown, the toner hopper according to this embodiment has the same components as that shown in FIG. 11 except a flat spring 56. The same components have the same reference numbers as those of FIG. 11.

The toner hopper is constructed so that the flat spring 56 is fitted to the handle gear 15*a*.

Figure 13:
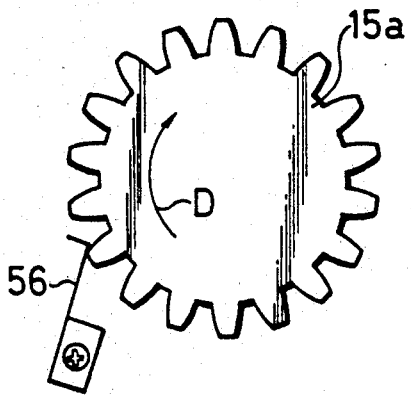
FIG. 13 is an explanatory view showing a relation between a handle gear and a flat spring when a handle is rotated clockwise.
Figure 14:
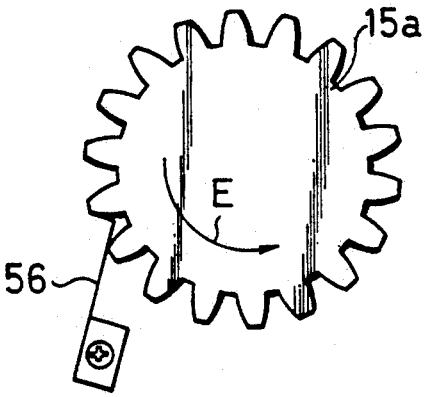
FIG. 14 is an explanatory view showing a relation between a handle gear and a flat spring when the handle is rotated counterclockwise.

FIG. 13 is an explanatory view showing a relation between the handle gear 15*a* and the flat spring 56 when the handle 55 is rotated clockwise. FIG. 14 is an explanatory view showing a relation between the handle gear 15*a* and the flat spring 56 when the handle 55 is rotated counterclockwise.

When the handle 55 is rotated clockwise (toward an arrow D), as shown in FIG. 13, the flat spring 56 is escaped to the outside against the teeth of the handle gear 15*a*. Hence, the handle gear 15*a* is rotated so that the rotation of the handle 55 may be transmitted to the stirring roller 12 through the rotation shaft 16.

On the other hand, when the handle 55 is rotated counterclockwise, as shown in FIG. 14, the flat spring 56 is engaged with the tooth of the handle gear 15*a*. Hence, the handle gear 15*a* is not rotated so that the counterclockwise turn of the handle 55 may be inhibited.

As is obvious from the above description, the flat spring serves to inhibit the counterclockwise turn of the handle 55. Hence, it is possible to prevent the rotation shaft 16 from being damaged by the large load applied when the handle 55 is turned counterclockwise. This makes it possible to prevent the occurrence of the operating trouble and the failure of the device.

The toner hoppers according to the first and the third inventions are constructed to manually turn the handle for turning the stirring roller only when the toner hopper is attached to the developing unit. This is intended to separate the stuck toner stored in the toner hopper into toner particles.

The manual turn of the stirring roller may be troublesome.

In turn, the description will be directed to the toner hopper for overcoming the shortcoming.

Figure 15:
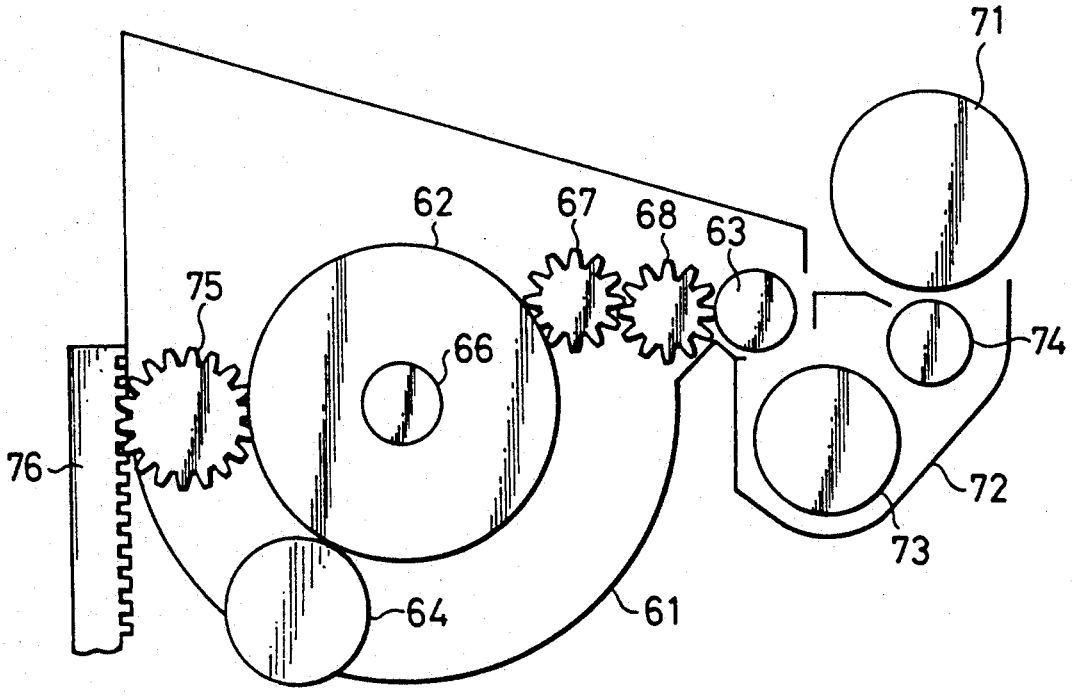
FIG. 15 is a front view schematically showing a toner hopper according to an embodiment of a fourth invention.
Figure 16:
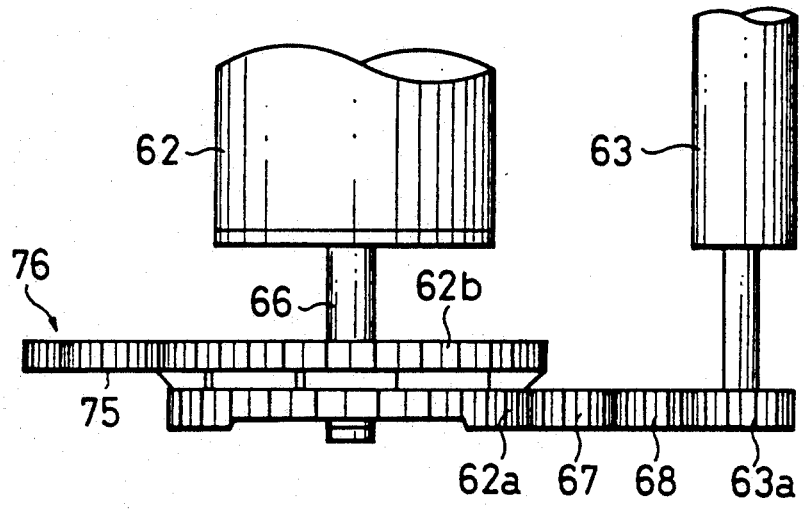
FIG. 16 is a plan view schematically showing an essential portion of the toner hopper shown in FIG. 15.

FIG. 15 is a front view schematically showing a toner hopper according to an embodiment of the fourth invention. FIG. 16 is a plan view schematically showing an essential portion of the toner hopper shown in FIG. 15. In FIG. 16, a gear 75 mates with a rack gear 76 provided in an image forming apparatus or a developing unit. A motor 64 shown in FIG. 15 is not illustrative.

As shown in FIGS. 15 and 16, the toner hopper 61 is attachable to a developing unit 72 which serves to feed the toner to a photosensitive drum 71. The developing unit 72 provides a stirring roller 73 for a developing agent and a magnet roller 74. The toner fed in the developing unit 72 is stirred by the stirring roller 73 and is fed to the photosensitive drum 71 with the toner being attracted on the surface of the magnet roller 74.

Inside of the toner hopper 61, a stirring roller 62 and a feeding roller 63 are fitted on the shafts. The toner hopper 61 provides gears 62*a*, 62*b*, 63*a*, a motor 64, a rotation shaft 66, gears 67 and 68.

The toner hopper 61 further provides a gear 75 which mates with the gear 62*b*. When the toner hopper 61 is attached to the developing unit 72, the gear 75 is constructed to mate with the rack gear 76 provided in the developing unit 72. Concretely, to attach the toner hopper 61 to the developing unit 72, the toner hopper 61 is pressed into the developing unit 72 with the gear 75 being engaged with the rack gear 76. As such, the rotation of the gear 75 is transmitted to the gear 62*b*, the rotation of which causes the stirring roller 62 to rotate through the rotation shaft 66.

The teeth of the rack gear 76 engaging with the teeth of the gear 75 may be formed so that one rotation of the stirring roller 62 corresponds to one rotation of the gear 62*b* when the toner hopper 61 is attached to the developing unit 72.

Figure 17:
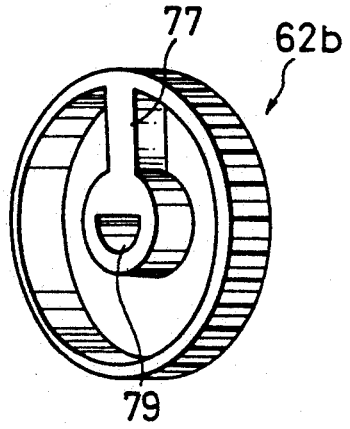
FIG. 17 is a perspective view showing a gear.
Figure 18:
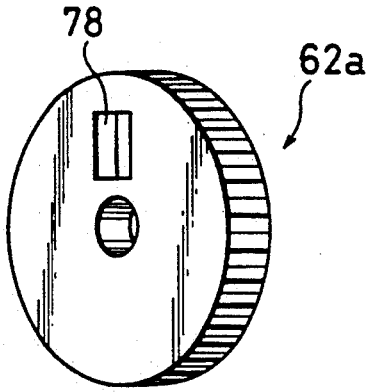
FIG. 18 is a perspective view showing another gear.

FIG. 17 is a perspective view showing a form of the gear 62*b*. FIG. 18 is a perspective view showing a form of a gear 62*a*.

When the motor 64 is driven with the toner hopper 61 being attached to the developing unit 72, the drive of the motor 64 is transmitted to the gear 63*a* through the gears 62*b*, 62*a*, 67 and 68. With the rotation of the gear 63*a*, the feeding roller 63 is rotated so that the toner may be fed to the developing unit 72.

At this time, a projection 77 formed on the gear 62*b* (see FIG. 17) comes into contact with a projection 78 formed on the gear 62*a* (see FIG. 18). The two gears 62*b* and 62*a* are rotated in concert for transmitting the drive of the motor 64.

The gear 62*b* has a D cut 79 on the central portion. The gear 62*a* is a so-called idle gear. As such, when the toner hopper 61 is attached to the developing unit 72, the gear 62*b* is rotated for driving the stirring roller 62, while the gear 62*a* is not rotated.

Thus, when the toner hopper is attached to the developing unit 72, the feeding roller 63 is not in operation.

When the toner hopper 61 is removed from the developing unit 72, the gear 75 is rotated in an opposite direction to the rotating direction of the gear given when the toner hopper 61 is attached to the developing unit 72. Hence, it may be possible to provide a one-way clutch so that the gear 62*b* is not allowed to rotate in the opposite direction.

According to this embodiment, as mentioned above, when the toner hopper 61 is attached to the developing unit 72, the gear 75 is pressed against the rack gear 76 with both of the gears being engaged with each other. Hence, the rotation of the gear 75 is transmitted to the gear 62*b*, the rotation of which is transmitted to the stirring roller 62 through the rotation shaft 66. The stirring roller 62 serves to stir the toner stored in the toner hopper 61. When the toner hopper 61 is attached to the developing unit 72, the gears 62*a* and 62*b* inhibit the interlocking of the feeding roller 63 with the stirring roller 62, that is, the operation of the feeding roller 63 though the stirring roller 62 is in operation.

Then, after the stirring roller 62 stirs the toner, the feeding roller 63 is interlocked with the stirring roller 62, so that the large load is not allowed to be applied to the motor 64.

It is therefore possible to prevent the occurrence of the operating trouble and the failure of the device, reduce the size of the device and lower the cost of the device.

The known toner hopper includes a motor which can produce a certain amount of torque, because it is driven at a constant voltage. Hence, if the toner particles are stuck together because of the vibration and the drop of the toner hopper when it is transported, the load of the motor supplying the force of rotation to the stirring roller becomes so large as causing the motor to be locked.

In turn, the description will be directed to a toner hopper which is capable of overcoming the shortcoming.

Figure 19:
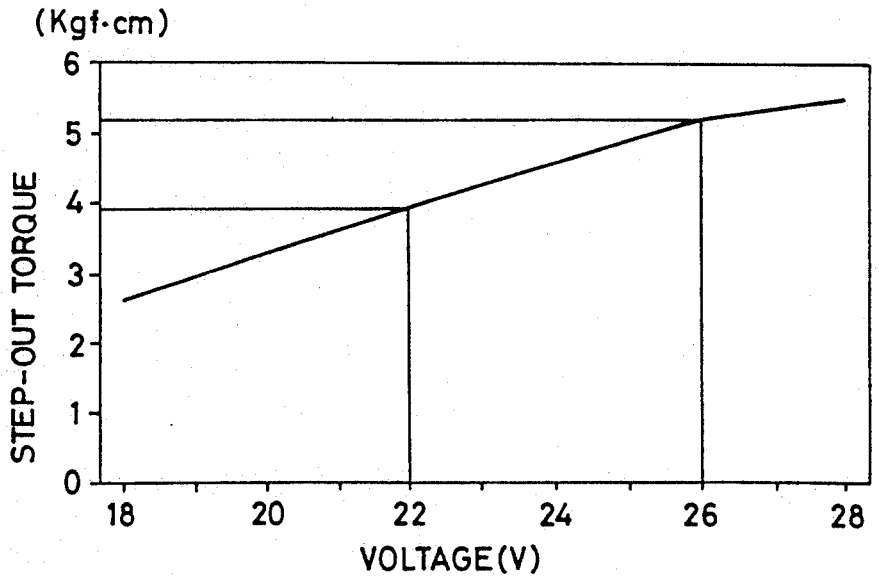
FIG. 19 is a graph showing a relation between a voltage of the motor included in the known toner hopper and a step-out torque.

FIG. 19 is a graph showing a relation between a step-out torque and a motor 114 provided in the known toner hopper.

As shown in FIG. 19, the motor 114 is normally driven at a supply voltage of 22 V at which the step-out torque is about 3.8 kgf. cm.

Figure 20:
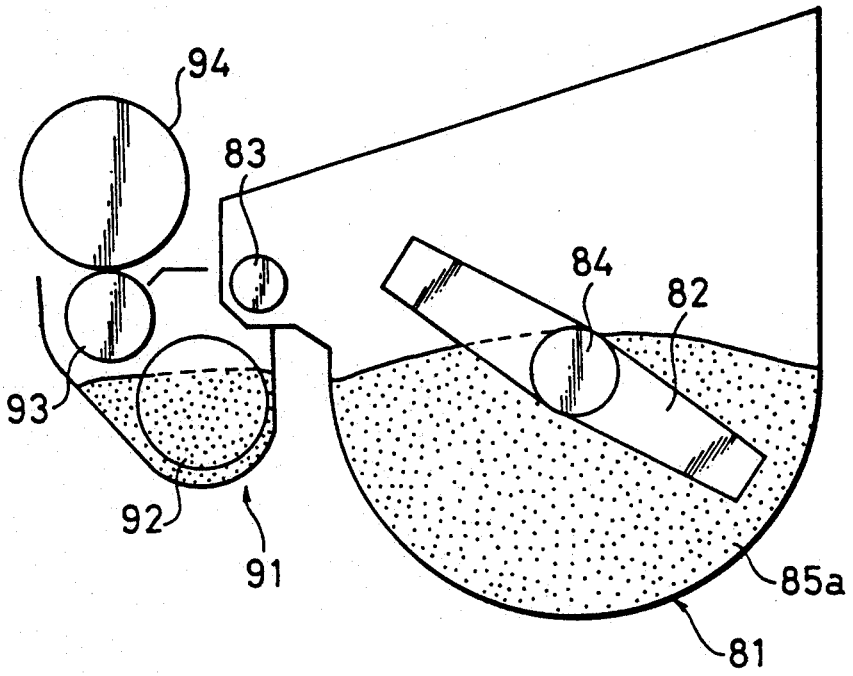
FIG. 20 is a schematic view showing the state of the toner appearing when the stirring roller included in a toner hopper according to a fifth invention starts to be driven.
Figure 22:
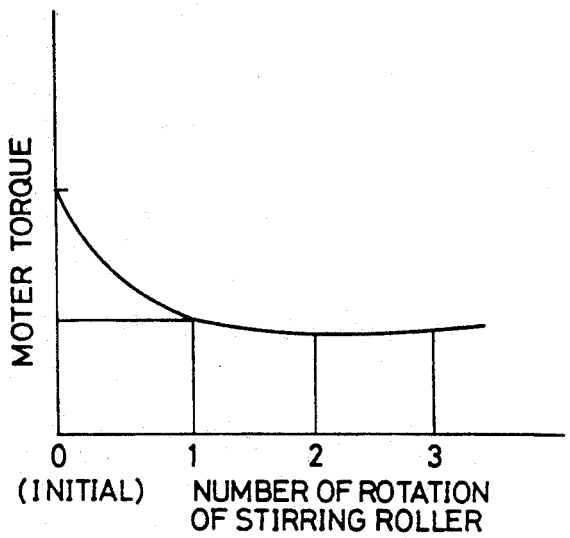
FIG. 22 is a graph showing a relation between the number of rotations of the stirring roller and the torque of the motor.

FIG. 20 is a schematic view showing the state of the toner appearing when a stirring roller included in a toner hopper according to an embodiment of a fifth invention starts to operate. FIG. 21 is a schematic view showing the state of the toner after the stirring roller turns once. FIG. 22 is a graph showing a relation a number of revolutions of the stirring roller and the torque of the motor.

As shown in FIGS. 20 and 21, the toner hopper 81 is attached to the developing unit 91. As shown, the developing unit 91 provides a stirring roller 92 for a developing agent and a magnet roller 93. The toner fed to the developing unit 91 is stirred by the stirring roller 92 and is fed to a photosensitive drum with the toner being attracted on the surface of the magnet roller 93.

Inside of the toner hopper 81, a stirring roller 82 and a feeding roller 83 are fitted on their shafts. The toner hopper 81 provides a rotation shaft 84. The other components are the same as those of the toner hopper according to the first invention. In this embodiment, however, the manual gear 12*a*, the handle 15 and the handle gear 15*a* shown in FIG. 1 are not inevitably required.

As shown in FIG. 20, when the motor starts to operate the stirring roller 82, the toner 85*a* is tight. Hence, at an initial stage, that is, when the stirring roller 82 starts to operate, as shown in FIG. 22, the motor needs to produce a relatively large amount of torque.

As shown in FIG. 21, when the stirring roller 82 turns once for stirring the toner, the toner becomes expansive. In this state, the necessary torque is decreased as shown in FIG. 22. When the stirring roller 82 turns to a certain degree, the motor needs to produce a lower amount of torque than that at the initial stage.

Considering the characteristics of the known motor, the toner hopper according to this embodiment provides a control circuit for switching a supply voltage to a larger voltage than a normal voltage when it needs to produce a larger amount of torque at the initial stage.

Figure 23:
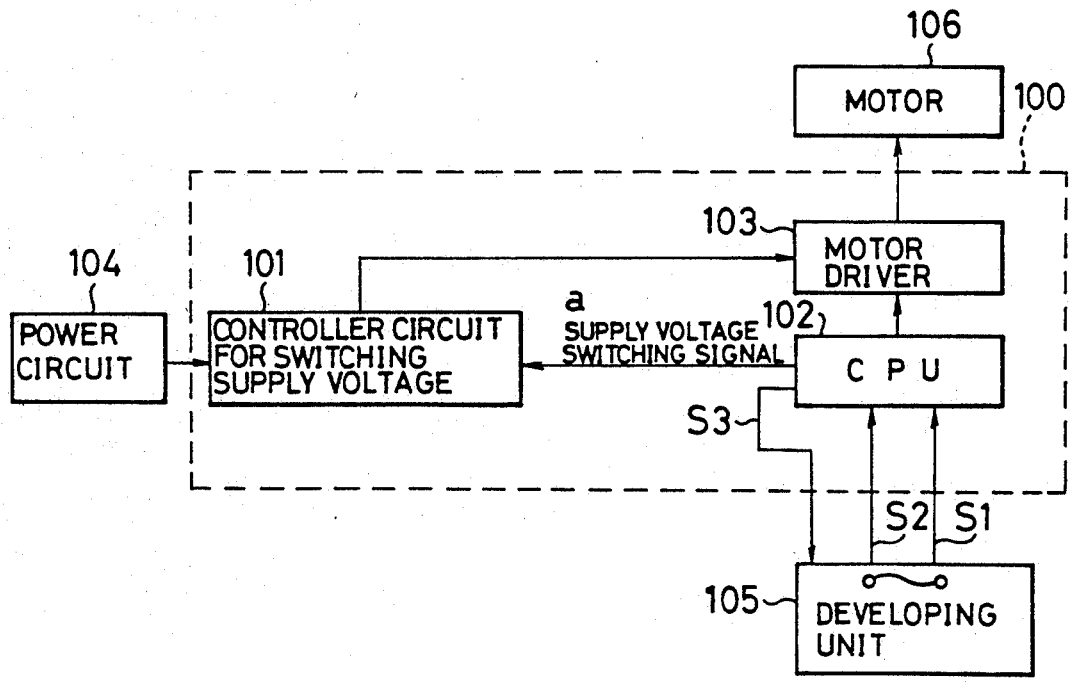
FIG. 23 is a block diagram showing a control circuit.

FIG. 23 is a circuit diagram showing the control circuit.

As shown, 100 denotes a control circuit which is arranged to have a controller circuit 101 for switching a supply voltage, a CPU (Central Processing Unit) 102 and a motor driver 103.

The controller circuit 101 is connected to a power source 104 and accepts a power switching signal from a CPU 102 and supplies a drive power voltage to a motor driver 103.

The CPU 102 is connected to a developing unit 105. The CPU 102 accepts a signal S1 indicating whether or not a fuse is melt and a toner density signal S2 and sends the fuse-melting signal S3. The CPU 102 is arranged to send a drive signal to the motor driver 103. The motor driver 103 is connected to a motor 106 such as a synchronous motor. The motor 106 corresponds to the motor 14 shown in FIG. 1.

Next, the description will be directed to how the CPU 102 switches the supply voltage of the motor 106.

Figure 24:
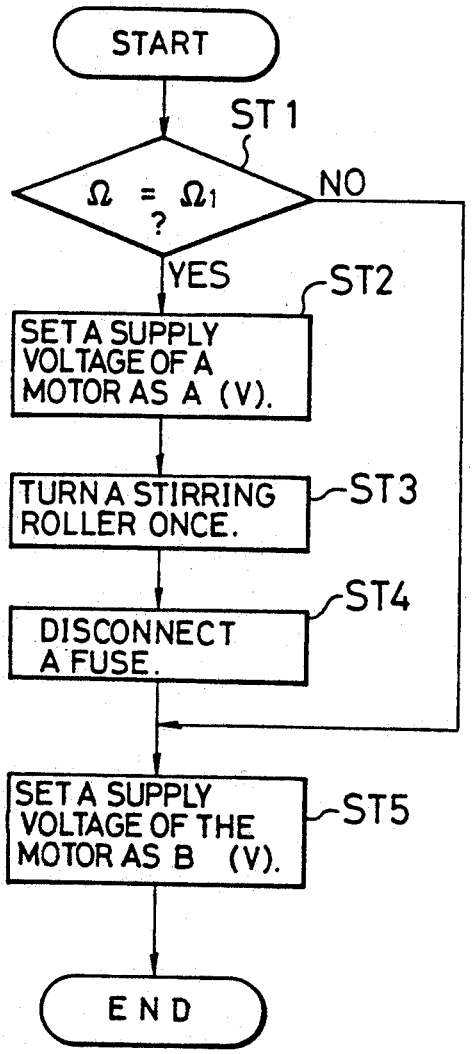
FIG. 24 is a flowchart for explaining the operation of switching a supply voltage of the motor.

FIG. 24 is a flowchart for illustrating the operation of switching the supply voltage of the motor 106.

As shown in FIG. 24, at a step ST1, it is determined whether or not a sensed resistance j of the fuse of the developing unit 105 is equal to a predetermined resistance j1. If yes, it is determined that the initial toner stirring is carried out. Then, the process goes to a step ST2. If no, it is determined that the toner stirring is not for the initial one. Then, the process goes to a step ST5.

At a step ST2, the supply voltage of the motor 106 is set as A (V). Herein, the supply voltage A(V) may be a supply voltage given when a larger amount of torque is needed at an initial stage, for example, 26 V as shown in FIG. 19 (about 5.2 kgf of the step-out torque).

In turn, at a step ST3, the motor is driven so that the stirring roller 82 may rotate once. At a step ST4, the fuse of the developing unit 105 is disconnected.

After the operation at the step ST4, or if it is determined that the sensed resistance j at the step ST1 is not equal to a predetermined resistance j1, the process goes to a step ST5. At this step, the supply voltage of the motor 106 is set as B (V), and the operation is terminated. Herein, the supply voltage B (V) may be a supply voltage needed to produce a normal amount of torque, for example, 22 V shown in FIG. 19 (about 3.8 kgf. cm of the step-out torque).

If the supply voltage is set, the amount of torque needed for the initial stirring can be increased to about 1.4 kgf.

The program corresponding to the flowchart shown in FIG. 24 is programmed in advance. The program is stored in a ROM (not shown) contained in the control circuit 100 and is read and executed by the CPU 102. Alternatively, it is arranged that the operation is started when a main switch of the image forming apparatus having the toner hopper attached thereto is pressed. By providing the control circuit to the toner hopper 11 according to the first invention, while the stirring roller 12 shown in FIGS. 1 and 2 turns substantially once, the rotation of the feeding roller can be inhibited. Hence, no toner is allowed to be fed into the developing unit if the torque of the motor is increased in the initial stirring operation.

According to this embodiment, after the motor 106 is driven, until the stirring roller 82 terminates one turn, the supply voltage fed to the motor 106 is switched to a higher voltage at which the motor 106 can produce a larger amount of torque for the initial stirring than the normal amount of torque. At a time, until the stirring roller 82 terminates one turn, the feeding roller 83 is not rotated. That is, before the feeding roller 83 starts to feed the toner, the stirring roller 82 serves to stir the stuck toner stored in the toner hopper 81. Then, the feeding roller 83 is interlocked with the stirring roller 82. Hence, no large load is applied to the motor 106. This results in reducing the necessary torque.

It is therefore possible to prevent the operating trouble and the failure of the device, reduce the size of the device and lower the cost of the device.

Many widely different embodiments of the present invention may be constructed without departing from the spirit and scope of the present invention. It should be understood that the present invention is not limited to the specific embodiments described in the specification, except as defined in the appended claims.

What is claimed is:

1. A toner hopper for feeding toner stored therein into a developing unit, comprising:

a stirring roller supported rotatably;

a feeding roller supported rotatably;

an interlocking mechanism for transmitting force of rotation of said stirring roller supplied from a driving means to said feeding roller;

means for manually rotating said stirring roller; and means for restricting operation of said interlocking mechanism such that the force of rotation of said stirring roller is not transmitted to said feeding roller while said manually rotating means supplies force of rotation to said stirring roller.

2. A toner hopper as claimed in claim 1, wherein said manually rotating means is composed of a handle and a handle gear and said restricting means is composed of projections.

3. A toner hopper as claimed in claim 1, wherein said manually rotating means provides means for inhibiting the rotation of said stirring roller in an opposite direction to the direction in which the force of rotation is supplied to said stirring roller.

4. A toner hopper as claimed in claim 3, wherein said inhibiting means is a flat spring.

5. A toner hopper for feeding toner stored therein into a developing unit, comprising:

a stirring roller supported rotatably;

a feeding roller supported rotatably;

an interlocking mechanism for transmitting force of rotation of said stirring roller supplied from a driving means to said feeding roller; and means for inhibiting the transmission of said force of rotation of said stirring roller to said feeding roller by means of said interlocking mechanism between an attachment of said toner hopper to said developing unit and the initial toner feeding.

6. A toner hopper as claimed in claim 5, wherein said inhibiting means is composed of a clutch.

7. A toner hopper as claimed in claim 5, wherein said inhibiting means is composed of a rib and a boss.

8. A toner hopper for feeding toner stored therein into a developing unit, comprising:

a stirring roller supported rotatably;

a feeding roller supported rotatably;

an interlocking mechanism for transmitting force of rotation of said stirring roller to said feeding roller; and means composed of a gear and a rack gear for supplying force of rotation to said stirring roller when said toner hopper is attached to said developing unit.

9. A toner hopper arranged to feed toner stored in it into a developing unit comprising:

a stirring roller supported rotatably;

a feeding roller supported rotatably;

an interlocking mechanism for transmitting force of rotation of said stirring roller supplied from a driving means to said feeding roller;

means for switching a supply voltage fed to said driving means when said driving means starts to be driven into a supply voltage higher than that at the normal operation of the stirring roller; and means for restricting operation of said interlocking mechanism so as to inhibit a transmission of the force of rotation of said stirring roller to said feeding roller when said driving means starts to be driven.

10. A toner hopper as claimed in claim 9, wherein said driving means is a motor to be operated at at least two voltages.

* * * * *